US006691543B2

(12) United States Patent
Steffens et al.

(10) Patent No.: US 6,691,543 B2
(45) Date of Patent: Feb. 17, 2004

(54) FIXED ROLL APPARATUS OF A FIXED ROLL MACHINE FOR CRANKSHAFTS

(75) Inventors: Hans-Toni Steffens, Erkelenz (DE); Hans Zimmermann, Selfkant (DE)

(73) Assignee: Hegenscheidt-MFD GmbH & Co. KG, Erkelenz (DE)

( * ) Notice: Subject to any disclaimer, the term of this patent is extended or adjusted under 35 U.S.C. 154(b) by 0 days.

(21) Appl. No.: 10/098,152

(22) Filed: Mar. 14, 2002

(65) Prior Publication Data

US 2002/0178775 A1 Dec. 5, 2002

Related U.S. Application Data

(63) Continuation of application No. 09/762,171, filed as application No. PCT/EP00/01848 on Mar. 24, 2000, now Pat. No. 6,393,887.

(30) Foreign Application Priority Data

Jun. 11, 1999 (DE) ..... 299 10 214 U

(51) Int. Cl.[7] ..... B21D 15/00
(52) U.S. Cl. ..... 72/110
(58) Field of Search ..... 72/107, 110, 101

(56) References Cited

U.S. PATENT DOCUMENTS 3,824,820 A * 7/1974 Jeuken et al. ..... 72/12.1
4,395,896 A * 8/1983 Yoshiwara et al. ..... 72/96
5,235,837 A * 8/1993 Werner ..... 72/69
6,094,956 A * 8/2000 Vodopyanov et al. ..... 72/110
6,434,992 B1 * 8/2002 Vodopyanov ..... 72/110

FOREIGN PATENT DOCUMENTS

DE 197 22 308 C1 4/1998

* cited by examiner

*Primary Examiner*—Ed Tolan
(74) *Attorney, Agent, or Firm*—Carlson, Gaskey & Olds

(57) ABSTRACT

The fixed roll apparatus (8) of a fixed roll machine (1) for crankshafts (3) is constructed scissors-fashion. Two pivotable scissor arms (9 and 10) disposed opposite one another each bear a fixed roll head (13) and a support roll head (14) respectively. The support roll head (14) has two axis-parallel support rolls whose axes of rotation lie in a common plane. The support roll head (14) also has an axial guide roll which is disposed in front of the support rolls in the pivoting direction (35) for closure and whose axis of rotation is perpendicular to the axis of rotation of the crankshaft (3) and lies in a plane which forms an acute angle with the common plane of the axis of rotation of the support rolls, its diameter being larger than the width of the support roll head (14) and slightly smaller than the spacing of the adjacent oil collars of a main bearing pin or a connecting rod bearing pin.

16 Claims, 5 Drawing Sheets

FIXED ROLL APPARATUS OF A FIXED ROLL MACHINE FOR CRANKSHAFTS

Figure 1:
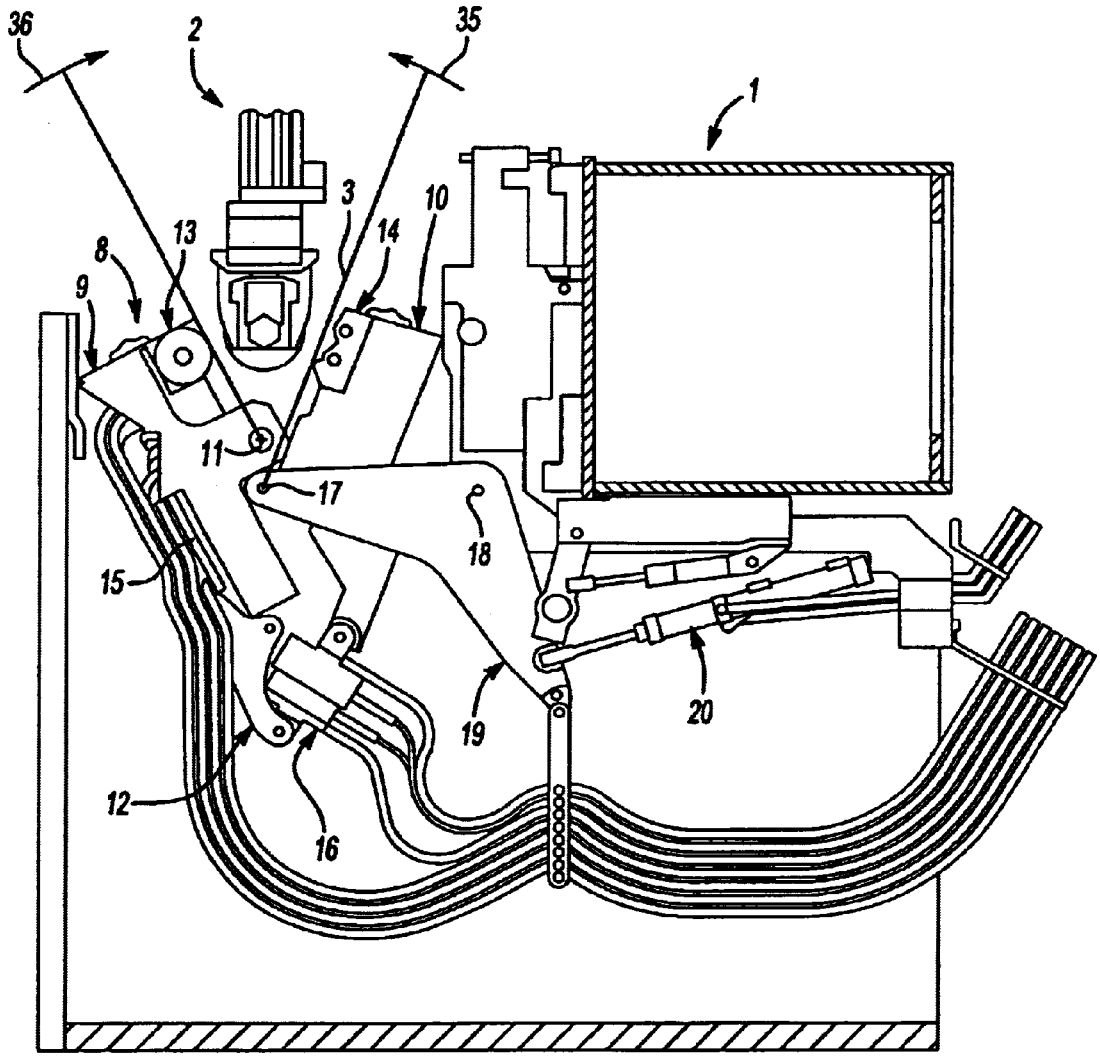

This application is a continuation of U.S. Ser. No. 09/762,171, filed Feb. 2, 2001, now U.S. Pat. No. 6,393,887, which is a 371 of PCT/EP00/01848, filed Mar. 24, 2000.

The invention relates to a fixed roll apparatus of a fixed roll machine for crankshafts which is of scissors construction and wherein two pivotable scissors arms disposed opposite one another bear a fixed roll head and a support roll head respectively, the support roll head having two axis-parallel support rolls whose axes lie in a common plane with a drive device which generates the closure and opening movement of the fixed roll apparatus and also generates the fixed roll force.

Fixed roll apparatuses of the kind specified are known from German Patent Specification DE 197 22 308 C1, which disclosed a fixed roll machine for crankshafts.

In such a fixed roll machine a fixed roll apparatus can be associated with each main bearing pin and connecting rod bearing pin of a crankshaft.

The construction of the fixed roll machine is such that during the closure of each fixed roll apparatus, first the support rolls of the support roll head then the fixed rolls of the fixed roll head are forced against a main bearing pin or a connecting rod bearing pin, the support roll head and the fixed roll head each performing a pivoting movement in succession.

The pivoting movement of the support roll and fixed roll heads in the closure direction involves the risk that the support roll and fixed roll heads may collide with the crankshaft in the zone of an oil collar, since there is only a small free space between the support roll and fixed roll heads on the one hand and the two oil collars of a main bearing pin or a connecting rod bearing pin on the other.

It is an object of the invention so to construct a fixed roll apparatus of the kind specified that the pivoting movement of the support roll and fixed roll heads in the closure direction cannot cause any collision with the crankshaft in the zone of an oil collar.

This problem is solved according to the invention by the features that the support roll head has at least one axial guide roll which is disposed in front of the support rolls in the pivoting direction for the closure of the scissors arm bearing the support rolls, whose axis of rotation is perpendicular to the axis of rotation of the crankshaft and lies in a plane which encloses an acute angle with the plane of the axes of rotation of the support rolls, and whose diameter is larger than the width of the support roll head and slightly smaller than the spacing of the oil collars of a main bearing pin or a connecting rod bearing pin.

The invention ensures that if during the closure operation of the fixed roll apparatus the guide roll knocks against an oil collar, the fixed roll apparatus is straightened in the axial direction of the crankshaft.

Such an alignment of the fixed roll apparatus ensures that even during the pivoting movement of the fixed roller head in the closure direction no collision can take place between the fixed roll head and the crankshaft in the zone of an oil collar.

In case the acute angle between the plane containing the axis of rotation of the axial guide roll and the common plane formed by the axes of rotation of the two support rolls falls to zero, the axial guide roll has a spacing from said common plane. The external contour of the axial guide roll can also have not only the conventional cylindrical shape, but other shapes being, for example, crowned or made up of a number of geometrical shapes.

For processing particularly wide shaft bearing pins it is possible to use not only one but several axial guide rollers which are disposed one beside the other and fill the free space circumscribed by two adjacent oil collars. Usually there are two axial guide rolls whose external width is such that the two axial guide rolls fit into the free space between the oil collars with a small lateral clearance. Such an arrangement also has the advantage that the axial guide rolls are relatively small. As a result, at the same time the lateral friction between the axial guide rollers and the oil collars is reduced.

Figure 2:
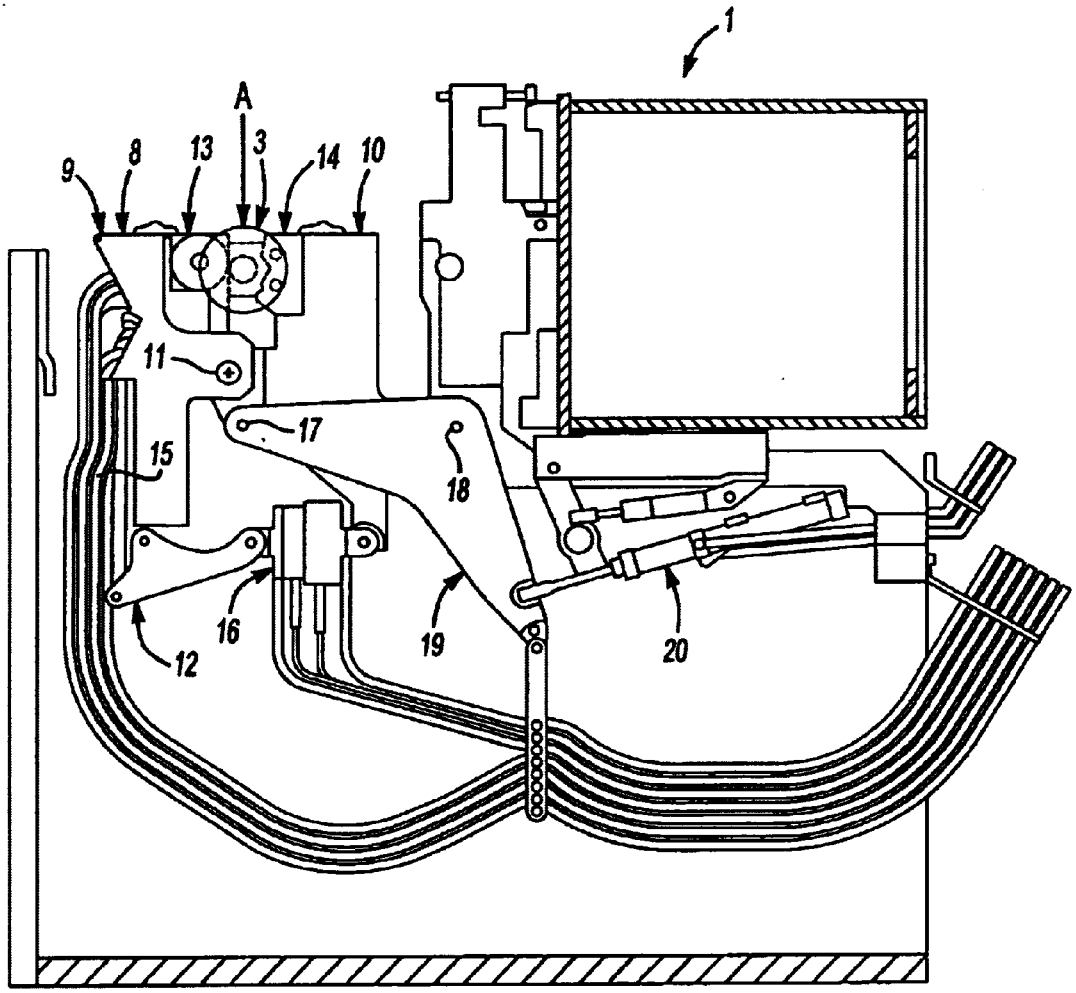
Figure 3:
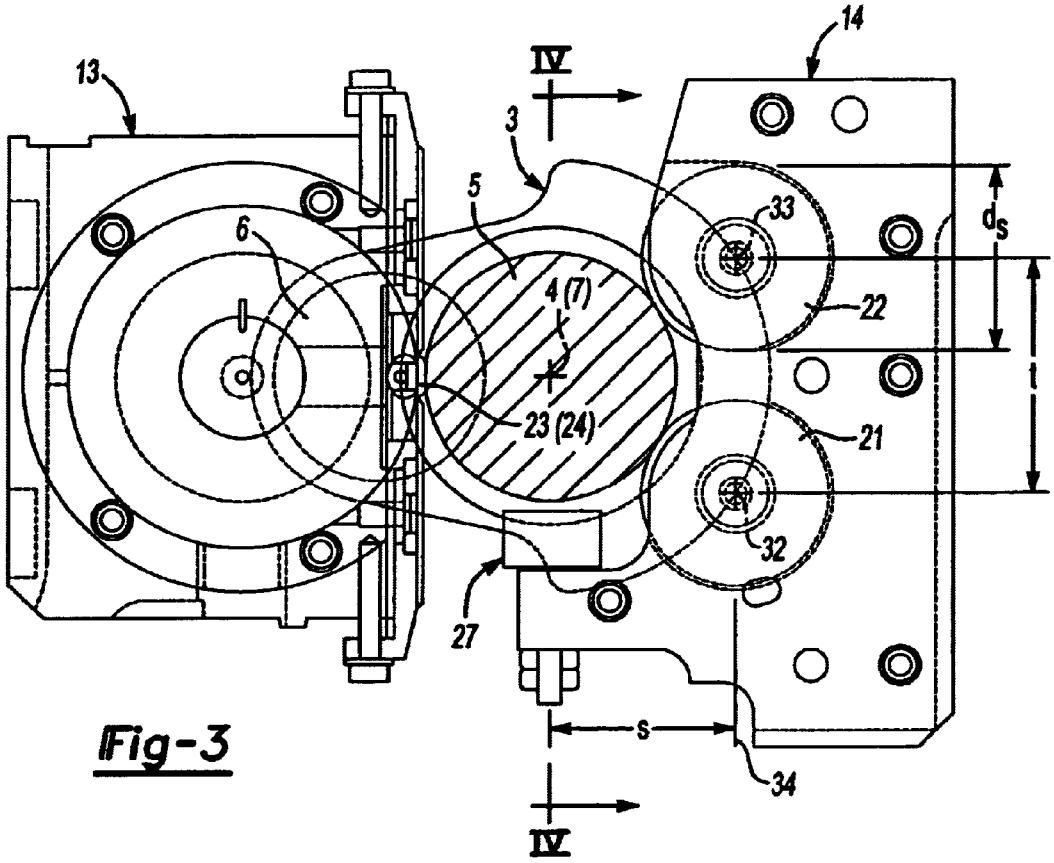
Figure 4:
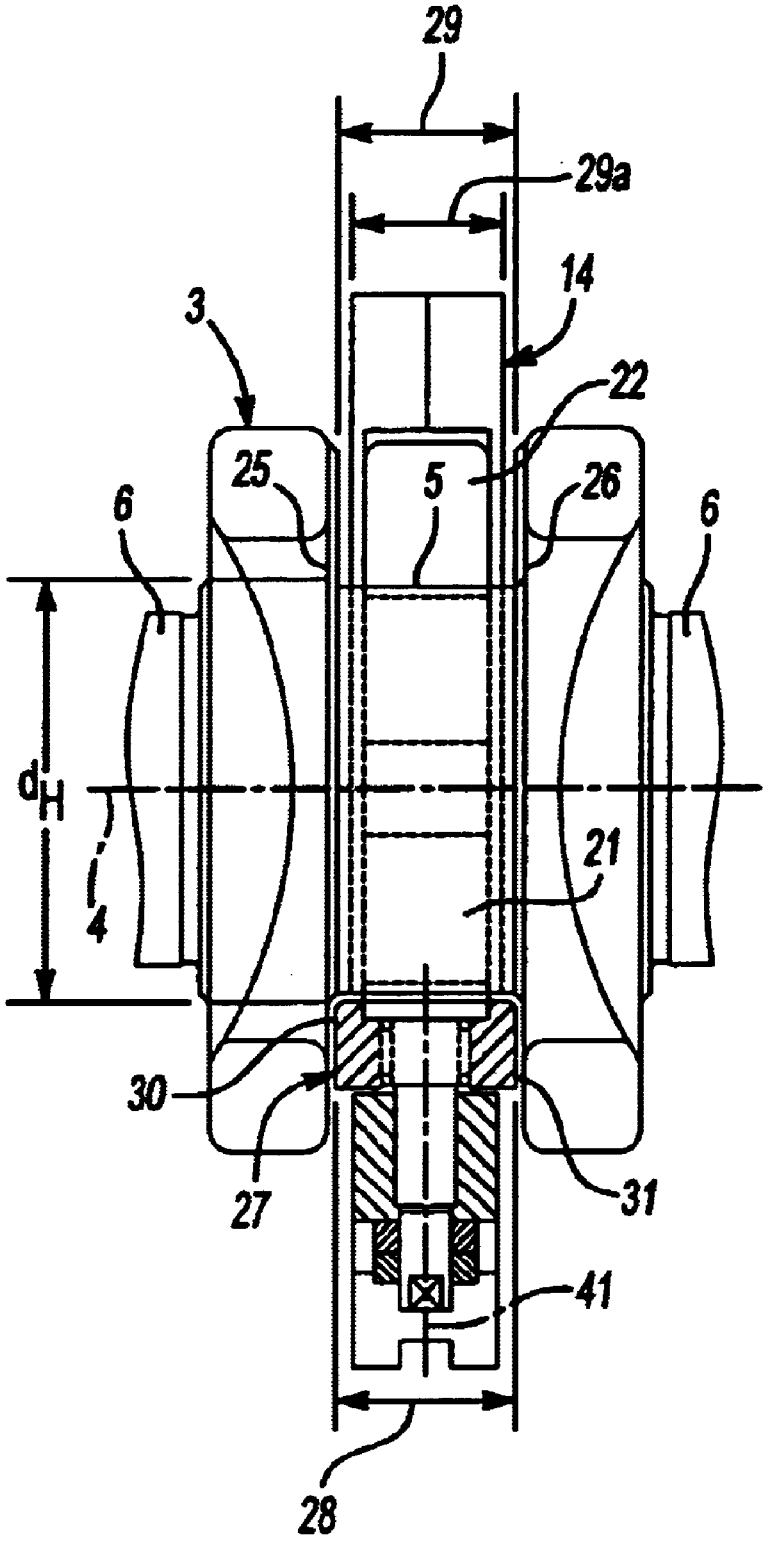
Figure 5:
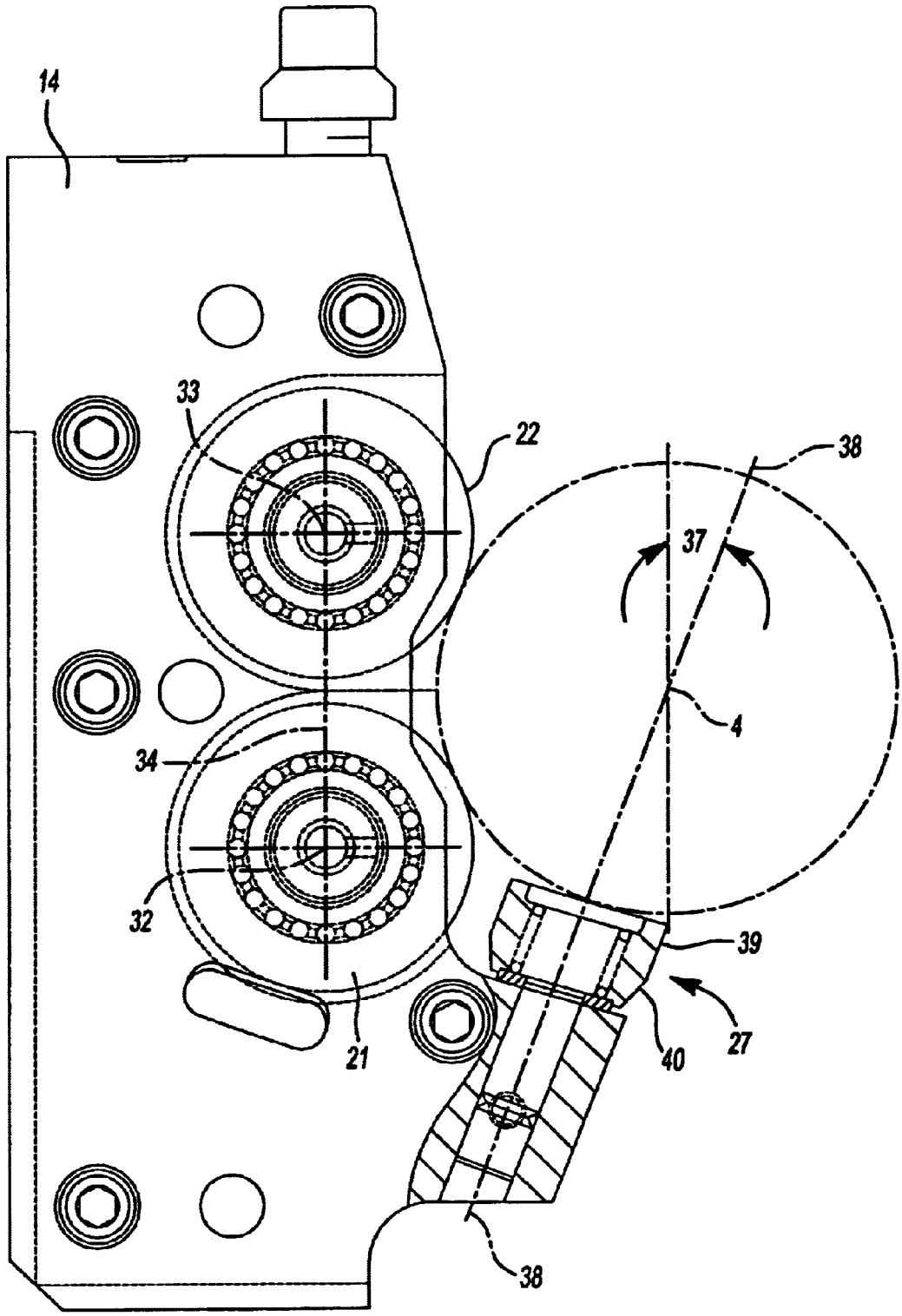

The invention will now be described in greater detail with reference to drawings which diagrammatically illustrate embodiment thereof and which show:

FIG. 1 a section through a fixed roll machine with a partial view of a crankshaft conveying device, wherein a fixed roll apparatus occupies its opening position in relation to an introduced crankshaft, FIG. 2 the section through the fixed roll machine and a section through a main bearing pin of the crankshaft, the fixed roll apparatus being in its closure position, FIG. 3 a detail A from FIG. 2 to an enlarged scale, FIG. 4 a section taken along the line IV—IV in FIG. 3, and FIG. 5 a section similar to FIG. 3 with a special arrangement of the axial support roll.

A fixed roll machine 1 has a driving device (not shown) for the reception of a crankshaft 3 introduced by a crankshaft conveying device 2.

The driving device generates the rotary movement of the crankshaft 3 around its axis 4 during the fixed rolling of a main bearing pin 5 and a connecting rod bearing pin 6. The axis 4 therefore lies in the axis of rotation 7 of the driving device.

However, the embodiment shown is limited to the fixed roll of a main bearing pin 5 of the crankshaft 3, since this is sufficient to explain the subject matter of the invention.

Associated with the main bearing pin 5 is a fixed roll apparatus 8 of scissors construction and having two scissors arms 9, 10, a scissors pivot 11, a driving device 12, a fixed roll head 13 and a support roll head 14. Due to the scissors construction, the fixed roll head 13 and the support roll head 14 cannot move individually in the direction along the axis of rotation 4, but they can be adjusted only in certain planes corresponding to the particular position of the main bearing pin 5/connecting rod bearing pin to be processed along the axis of rotation 4 of the crankshaft 3. Such a plane is shown by way of example in FIG. 3.

The driving device 12 has an adjusting cylinder 15 and a force apparatus 16.

The adjusting cylinder 15 generates the closure and opening movement of the aforedescribed scissors of the fixed roll apparatus 8, the force apparatus 16 generates the fixed roll force. A particularly narrow construction of the fixed roll apparatus 8 is achieved by the subdivision of the movements generated by the cylinders 15 and 16.

The fixed roll apparatus 8 is articulated via a point of articulation 17 to a toggle lover 19 pivotable around an axis 18.

The toggle lever 19 can be pivoted by means of a piston-and-cylinder unit 20. The fixed roll apparatus 8 is moved into and out of the operating position by the actuation of the piston-and-cylinder unit 20.

The fixed roll machine 1 is so designed that during the closure of the fixed roll apparatus 8 first the two axis-parallel support rolls 21, 22 of the support roll head 14 and then the two fixed rolls 23, 24 of the fixed roll head 13 come to bear against the main bearing pin 5.

As viewed in FIG. 1, the support roll head 14 makes an anti-clockwise pivoting movement 35 around the point of articulation 17, the fixed roll head 13 making a clockwise pivoting movement 37 around the scissors pivot 11. The two pivoting movements 35 and 36 are performed simultaneously and when each is completed the closure position is reached, as shown in FIG. 2. The closure position corresponds to the operating position of the fixed roll apparatus 8.

During the pivoting movements 35, 36 of the support roll head 14 and the fixed roll head 13 in the closure direction, any collision with one of the two oil collars 25, 26 of the main bearing pin 5 is prevented by an axial guide roll 27. The axial guide roll 27 is disposed at an acute angle 37 between 0 and 45° and in a plane 38. The pivoting axis 41 around which the axial guide roll 27 can be rotated lies in a plane 38 and is perpendicular to the axis of rotation 4 of the crankshaft 3 (FIG. 4).

Geometrically viewed, the plane 38 also encloses the axis of rotation 4 of the crankshaft 3—i.e., the plane 38 can rock around the axis of rotation 4. A comparison of FIGS. 3 and 5 clearly indicates this possibility. For example, as viewed in FIG. 3, the plane 38 falls in the sectional plane IV—IV—i.e., the acute angle 37 is zero and the axial guide roller 27 has a lateral spacing s from the plane 34 in which the two axes 32 and 33 lie. In the special case the two planes 34 and 38 extend parallel with one another.

In contrast, as shown in FIG. 5 the axial guide roll 27 is inclined at an acute angle 37 grater than zero in relation to the common plane 34 of the two axes 32 and 33 of the particular support rolls 21 and 22. As a result of this construction, when the support roll head 14 is pivoted into the closure position in the direction of the pivoting movement 35, the axial guide roller 27 leads on the two support rolls 21 and 22. In front of the support rolls 21 and 22 the axial guide roll 25 enters the free space which is circumscribed by the spacing 29*a* of the two oil collars 25 and 26 on the main bearing pin. In this way when the fixed roll apparatus 8 is closed, neither of the support rolls 21 or 22 knocks against one of the oil collars 25 or 26.

The axial guide roll 27 can have different shapes. For example, as shown in FIG. 3 it has a cylindrical shape. As shown in FIG. 5 the axial guide roll 27 has a multiple contour which is made up of a cylindrical portion 39 and a conical portion 40. The axial guide roll 27 can also be constructed crowned (not shown). In the case of bearing pins 5 which have a particularly width 29*a*, two axial guide rolls (not shown) disposed one beside the other can be substituted for a single axial guide roll 27, on guide roll bearing against the oil collar 25 and the second against the oil collar 26.

Due to the scissors construction of the fixed roll apparatus 8, the axial guide roll 27 at the same time also guides the fixed roll head 13 in the axial direction.

The diameter 28 of the axial guide roll 27 is larger than the width 29 of the support roll head and slightly smaller than the spacing 29*a* of the oil collars 25, 26 of the main bearing pin 5.

In the closure position of the securing roll apparatus 8 (FIG. 2), for the two free spaces 30, 31 a clearance of approximately 0.25 mm is provided on each side between the oil collars 25, 26 and the guide roll 27.

What is claimed is:

1. A machine for a fillet-rolling crankshaft bearings comprising:

first and second arms moveable relative to one another between open and closed positions;

a fixed roll head supported on one of said arms for fillet-rolling crankshaft bearing fillets the fixed roll head including a fixed roller rotatable about an associated first axis;

a support roll head supported on the other of said arms for supporting the crankshaft bearing, the support roll head including a roller rotatable about a associated second axis; and a guide roller supported on one of said fixed roll head and said support roll head for laterally locating said one of said fixed roll head and said support roll head in said closed position relative to the crankshaft. the grid roller rotatable about a guide axis nor parallel with the associated axis of the one of said fixed roll head and said support roll head.

2. The machine according to claim 1, wherein said guide roller is support on said roll head.

3. A machine for a fillet-rolling crankshaft bearings comprising:

first and second arms moveable relative to one another between open and closed positions;

a fixed roll head supported on one of said arms for fillet-rolling crankshaft bearing fillets;

a support roll head supported on the other of said arms for supporting the crankshaft bearing, wherein said support roll head includes a support roller for engaging the crankshaft bearing with said support roller being rotatable about a first axis: and a guide roller supported on one of said fixed roll head and said support roll head for laterally locating said fixed and support roll heads in said closed position relative to the crankshaft, said guide roller rotatable about a second axis transverse to said first axis.

4. The machine according to claim 3, wherein said first and second axes are approximately 90° relative to one another.

5. The machine according to claim 3, wherein said guide roller is supported on said support roll head.

6. A machine for fillet-rolling crankshaft bearings comprising:

a crankshaft having an oil collar and a cylindrical bearing generally transverse to said oil collar with a fillet arranged between said bearing and said oil collar;

a fixed roll head having a fixed roller engaging said fillet in a closed position for plastically deforming said fillet, the fixed roller rotatable about a first axis;

a support roll head having a support roller engaging said bearing in said closed position for supporting said bearing during fillet rolling of said fillets, the support roller rotatable about a second axis parallel to the first axis, the first and second axes defining a plane; and a guide roller supported on one of said roll heads for laterally locating said roll heads in said closed position relative to said oil collar, the guide roller rotatable about a guide axis not parallel to the first axis and not parallel to the second axis.

7. The machine according to claim 6, wherein said guide roller is supported on said support roll head for rotation about the guide axis.

8. A method of fillet-rolling a crankshaft bearing comprising the steps of:

a) loading a crankshaft having a crankshaft axis into a fillet-rolling position;

b) moving fixed and support roll heads toward the crankshaft;

c) engaging a crankshaft oil collar with a guide roller rotatable about a guide axis nor parallel to the crankshaft axis;

d) laterally locating the fixed and support roll head parallel to the crankshaft axis there by causing rotation of the guide roller about the guide axis;

e) engaging the crankshaft with a support roller on the support roll head; and f) engaging the fillets with a fixed roller on the fixed roll head.

9. A roll head for fillet-rolling crankshaft bearing fillets comprising:

a first rotatable about a first axis;

a second roll rotatable about a second axis parallel to the first axis;

a guide roll rotatable about a guide axis not parallel to said first axis and said second axis; and a housing rotatably supporting the first roll, the second roll and the guide roll.

10. The roll head of claim 9 wherein the first axis and the second axis define a plane, the guide axis extending at an acute nonzero angle relative to the plane.

11. The roll head of claim 10 wherein a diameter of the guide roll is greater than a width of the first roll.

12. The roll head of claim 9 wherein the guide axis is arranged to extend at least substantially perpendicularly through a crankshaft axis of a crankshaft engaged by the first and second rolls.

13. A roll head for fillet-rolling crankshaft bearing fillets comprising:

a first roll rotatable about a first axis;

a second roll rotatable about a second axis parallel to the first axis;

a guide roll rotatable about a guide axis transverse to said first axis and said second axis; and a housing rotatably supporting the first roll, the second roll and the guide roll, wherein the housing, the first roll or second roll includes an outermost surface generally perpendicular to the first axis and the second axis and wherein at least one tangential surface of an outer circumference of the guide roll protrudes outwardly past a plane generally containing the outermost surface.

14. The roll head of claim 13 wherein the housing includes an outer surface generally perpendicular to the first axis and second axis and wherein the outer surface of the housing is the outermost surface.

15. The roll head of claim 13 wherein the first axis and the second axis define a plane , the guide axis extending at an acute nonzero angle relative to the plane.

16. A roll head for fillet-rolling crankshaft bearing fillets comprising;

a first roll rotatable about a first axis;

a second roll rotatable about a second axis parallel to the first axis;

a housing rotatably supporting the first roll and the second roll;

the housing, the first roll and the second roll including an outermost point in an outer plane perpendicular to the first axis and the second axis;

a guide roll rotatably supported on the housing and rotatable about a guide axis extending at an acute nonzero angle relative to a plane containing the first axis and the second axis, wherein the guide roll includes at least one tangential surface on its outer circumference that protrudes at least partially outwardly past the outer plane.

* * * * *

UNITED STATES PATENT AND TRADEMARK OFFICE

CERTIFICATE OF CORRECTION

PATENT NO. : 6,691,543 B2
DATED : February 17, 2004
INVENTOR(S) : Steffens et al.

It is certified that error appears in the above-identified patent and that said Letters Patent is hereby corrected as shown below:

Column 3,
Line 67, please insert a -- , -- after “fillets” and before “the”.

Column 4,
Line 5, “a” that is before “associated” should read as -- an --.
Line 10, “.” should read as -- , --.
Line 11, “nor” should read as -- not --.
Lines 14-15, should read as follows:
-- The machine according to claim 1, wherein said guide roller is supported on said support roll head. --.
Line 66, “nor” should read as -- not --.

Column 5,
Line 2, “there by” should read as -- thereby --.
Line 10, please insert -- roll -- after “first” and before “rotatable”.

Signed and Sealed this

Twenty-seventh Day of April, 2004

JON W. DUDAS
*Acting Director of the United States Patent and Trademark Office*